US005228210A

United States Patent [19]

Hofmuth et al.

[11] Patent Number: 5,228,210

[45] Date of Patent: Jul. 20, 1993

[54] METHOD OF AND APPARATUS FOR DRYING FOR FILM DEVELOPING DEVICE

[75] Inventors: Walter Hofmuth, Munich; Rudolf Loistl, Unterhaching; Helmut Schausberger, Munich; Alfons Kastl, Munich; Jürgen Mueller, Munich, all of Fed. Rep. of Germany

[73] Assignee: Agfa-Gevaert AG, Leverkusen, Fed. Rep. of Germany

[21] Appl. No.: 728,550

[22] Filed: Jul. 11, 1991

[30] Foreign Application Priority Data

Aug. 4, 1990 [DE] Fed. Rep. of Germany ..... 4024866

[51] Int. Cl.[5] ..... F26B 7/00

[52] U.S. Cl. ..... 34/18; 34/4; 34/68; 34/41; 34/1; 34/30; 34/44

[58] Field of Search ..... 34/1 W, 1, 4, 18, 68, 34/155, 41, 39, 44, 54, 48, 30; 354/300

[56] References Cited

U.S. PATENT DOCUMENTS

| | | | |
|---|---|---|---|
| 2,571,815 | 10/1951 | Benoit et al. | 34/18 |
| 3,720,002 | 3/1973 | Martin | 34/18 |
| 3,826,014 | 7/1974 | Helding | 34/1 AA |
| 3,973,328 | 8/1976 | Theobald | 34/4 |
| 4,495,713 | 1/1985 | Williner | 34/4 |
| 4,594,795 | 6/1986 | Stephansen | 34/4 |
| 4,658,512 | 4/1987 | Fleissner | 34/4 |
| 4,693,013 | 9/1987 | Pabst et al. | 34/4 |
| 4,783,908 | 11/1988 | Pabst | 34/4 |
| 5,097,605 | 3/1992 | Kashino et al. | 34/18 |

*Primary Examiner*—Henry A. Bennet
*Assistant Examiner*—Denise L. F. Gromada
*Attorney, Agent, or Firm*—Michael J. Striker

[57] ABSTRACT

A method of drying a developed, wet sheet carrier, especially an X-ray film after passing through a development device includes passing the sheet carrier through a dryer which has several infrared radiators arranged along the path of the sheet carrier at its both sides and reflectors provided at the side away from the sheet carrier and deflecting the infrared radiator to the facing side of the sheet carrier. The method is performed so that a main stream is supplied at both sides of the sheet carrier at the rear side of the reflectors, a partial air stream is supplied between each infrared radiator and the sheet carrier, and then each partial air stream is united with the main air stream so that the temperature and the moisture of the main air stream increases in a flow direction.

20 Claims, 5 Drawing Sheets

METHOD OF AND APPARATUS FOR DRYING FOR FILM DEVELOPING DEVICE

BACKGROUND OF THE INVENTION

The present invention relates to a method of drying a developed, wet sheet carrier and an arrangement for performing the method.

A drying device is disclosed in the German document DE-PS 3,124,688, in which only one radiator pair with the reflectors arranged behind them, and behind it a not shown blower with a fresh air passage are provided. The blowers operate for withdrawing water vapors produced during drying on the one hand. On the other hand the transporting rollers are cooled by the supplied fresh air in idle and therefore a disadvantageous, indefinite pre-drying of the sheet carrier on the rollers during transportation of a new material is prevented. The guiding surfaces extend after the radiators for guiding the sheet carrier, toward subsequent pair of rollers. When one radiator pair in the known drying device is not sufficient for a fast, satisfactory drying of great sheet carrier quantities, it was necessary to provide several radiator pairs each with two blowers and fresh air passages one after the other. Such a construction occupies a lot of space and, due to the great number of blowers and air shafts, is expensive.

German document DE-OS 2,323,725 shows a dryer in which at each side of the guiding path for the sheet carrier a blower is arranged. Each blower supplies the fresh air in a kind of pressure chamber, from which the air is directed to the sheet carrier through individual air sources. Cool fresh air is applied with each air source unto the sheet carrier and provides simultaneously cooling and removal of water vapor produced by the infrared radiation. The drying itself is performed here exclusively by the infrared radiation. For providing all air sources with the respective quantity of cool fresh air, high intensity blowers with high space consumption are required. The feed quantity of the blowers must be adapted to the number of the air sources, or in other words to the number of the infrared radiators.

German document DE-OS 2,153,752 describes a pure convection dryer. In this convection dryer the warmed air is supplied to the sheet carrier.

SUMMARY OF THE INVENTION

Accordingly, it is an object of the present invention to provide a method of drying of a developed, wet sheet carrier and an arrangement for performing the method, which are designed so that the efficiency of the dryer is improved and adaptation to the power requirement which is dependent on the utilization can be achieved without high expenses.

In keeping with these objects and with others which will become apparent hereinafter, one feature of the present invention resides, briefly stated, in a method of drying a developed, wet sheet carrier, especially an X-ray film after passing through a developing device, in which the sheet carrier is guided through a dryer having several infrared radiators arranged along the path of the sheet carrier at both sides, and the deflectors are provided at the side facing away from the sheet carrier for deviating the infrared radiation to the side of the sheet carrier facing them, wherein a main air stream is supplied at both sides of the sheet carrier at the rear side of the reflectors, and a partial air stream is supplied between an infrared radiator and the sheet carrier and then is again united with the main air stream, so that the temperature and the moisture of the main air stream is increased in the flow direction.

It is another feature of the present invention to provide an arrangement for performing the method which has at least one pair of oppositely located infrared radiators with reflectors arranged behind them, roller pairs located before and after the radiator pair and operative for transporting a developed, moist sheet carrier, and a fresh blower at each side of the sheet carrier web, wherein the fresh air blowers are arranged in direction of the sheet carrier path before and after the pair or the pairs of the radiatorsat both sides of the sheet carrier path defined by the roller pair and formed as transverse flow blowers, and their air streams are directed in the sheet carrier running direction or opposite to said direction.

The inventive method makes possible a modular construction of the dryer, in which only the number of the radiators must be adjusted to the required dryer power, without adjusting the blowers. Due to the use of structurally small and noiseless transverse flow blowers, together with the guiding surfaces which are inclined from the blowers to the path, an especially space-economical and cost-favorable drying arrangement is provided. The operation of the dryer is also cost-economical as compared with the prior art. Since the air flowing in the space between the infrared radiators and the sheet carrier is not withdrawn from the system but instead is mixed with the main air stream, the energy with which the air is heated by the radiator is not lost and remains in the system. This combined radiation-convection drying has a further advantage in that a non-uniform drying output between illuminated (dark) and not illuminated (bright) locations, such as in the pure radiation drying, is at least strongly reduced. Since the heated air removes a lot of moisture from the sheet carrier, the different absorption abilities of the dark and bright locations of the sheet carrier for the infrared radiation do not act intensely.

In accordance with the present invention the convection portion is further increased. For this purpose it is possible on the one hand to make the reflectors which are normally produced from very thin materials, of a thick material with high heat capacity. On the other hand, at least at each side of the sheet carrier one reflector can be removed so that the corresponding radiator can act also on the air stream and heat the same. When in addition all parts acted upon by the radiation are colored black, the efficiency is increased further.

For increasing the convection part in the above described manner, the radiator power must not be increased. By a control, the dryer can be regulated so that the heating is performed in the intervals and during the heating phase of the bath in the developing device. The dryer is therefore controlled so that during this time it is operated when the temperature in the exhaust air is lowered under a predetermined minimum and again stopped when the temperature reaches a maximum. A regulation during the drying operation can be performed by the temperature of the exhaust air through a power control of the radiators without reflectors.

In accordance with another feature of the present invention, the special construction of the housing of the device and the radiators on one path side formed as a coverlike swingable unit provides for a good accessibility over long dryer paths in the emergency situation or for service purposes.

Still another feature of the present invention is that the individual dryer elements are formed as identical parts or in other words they are identical radiators and reflectors and identical blowers and shaft parts. Thus mounting of the dryers with different power and structural length with a smaller number of structural elements to be mounted and smaller bearing supports is possible. As in the known dryers, uniform fresh air supply and uniform drying quality is achieved.

The inventive drying device can be executed both in a vertical modification and in a horizontal modification.

Finally, the air stream of blowers can be supplied into the chamber of the dryer and then discharged through discharge hoses or shafts to suitable spaces, for example adjacent chambers without loading the working spaces.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
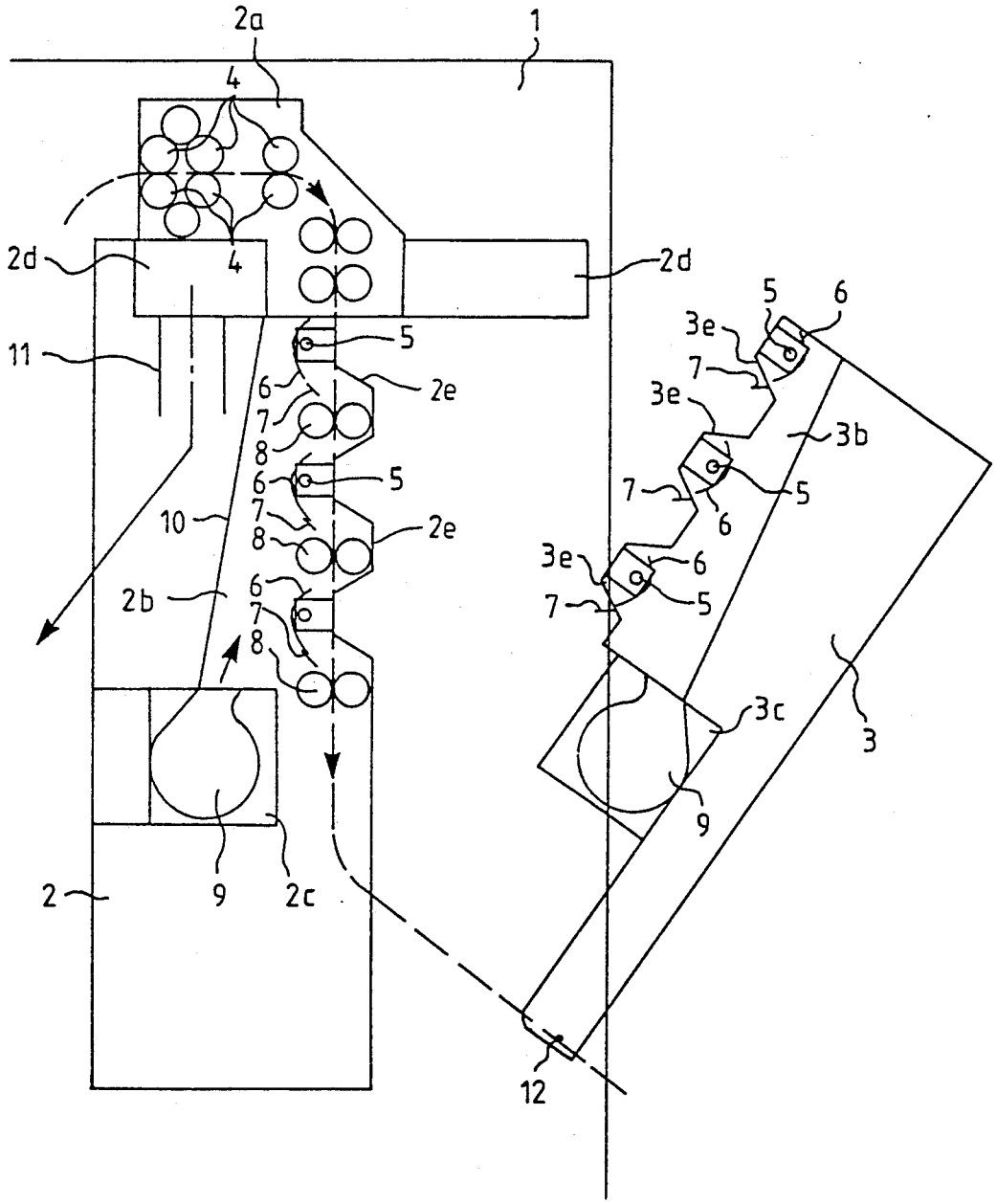
FIG. 1 is a schematic view of a dryer in accordance with the present invention which is open in the event of the repair or damage.
Figure 2:
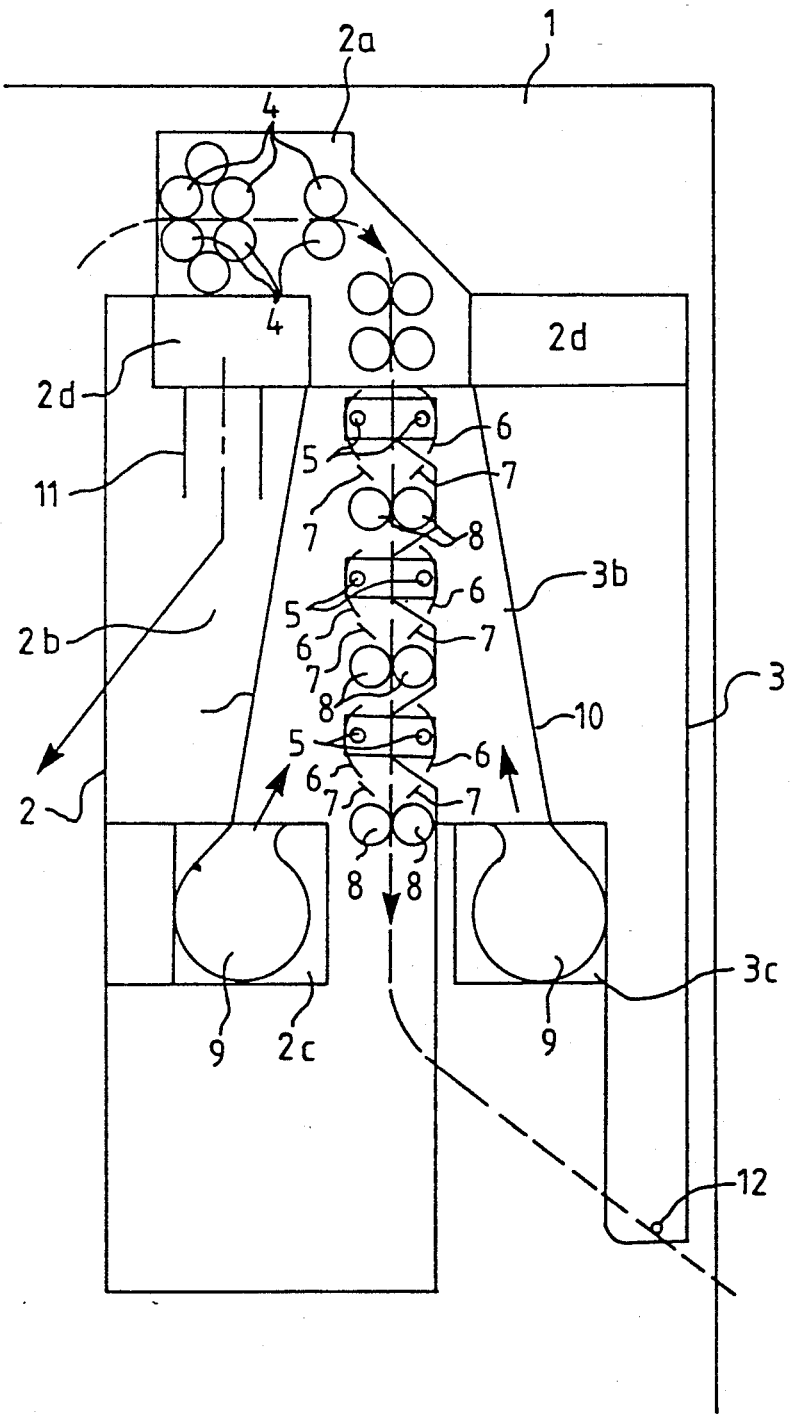
FIG. 2 is a dryer in accordance with the present invention as shown in FIG. 1, in condition of its use.

In FIGS. 1 and 2 of the drawings a support part or a part of a housing of a dryer in accordance with the present invention is identified with reference numeral 1. Housing parts 2 and 3 for a developed, light sensitive sheet carrier are supported on the part 1. Before the dryer, as considered in direction of transportation of the sheet carrier, a not shown development machine of any known art is mounted on the support part 1, so that it is fixedly associated with the dryer. The housing part is arranged stationarily and subdivided into several chambers.

A chamber 2*a* is used for inlet transporting rollers 4. A chamber 2*b* serves for several infrared radiators 5 which are arranged one behind the other in a sheet carrier transporting direction and provided with rear reflectors 6. The chamber 2*b* also accommodates guiding sheets 7 inclined toward a transporting path and located between the infrared radiators 5, and also transporting rollers 8 arranged behind the guiding sheets 7. A chamber 2*c* accommodates a transverse stream blower 9. A guiding sheet 10 extends from the chamber 2*c* behind the reflectors 7 and is inclined relative to the transporting path. The guiding sheet 10 forms a part of an air shaft. A chamber 2*d* is formed so that a moist blower air after passing through the dryer opens into it. It can be supplied through a discharge 11 via a hose into the environment or another suitable chamber, so that it does not load the structural and working chambers of the development machine and the dryer.

Figure 3:
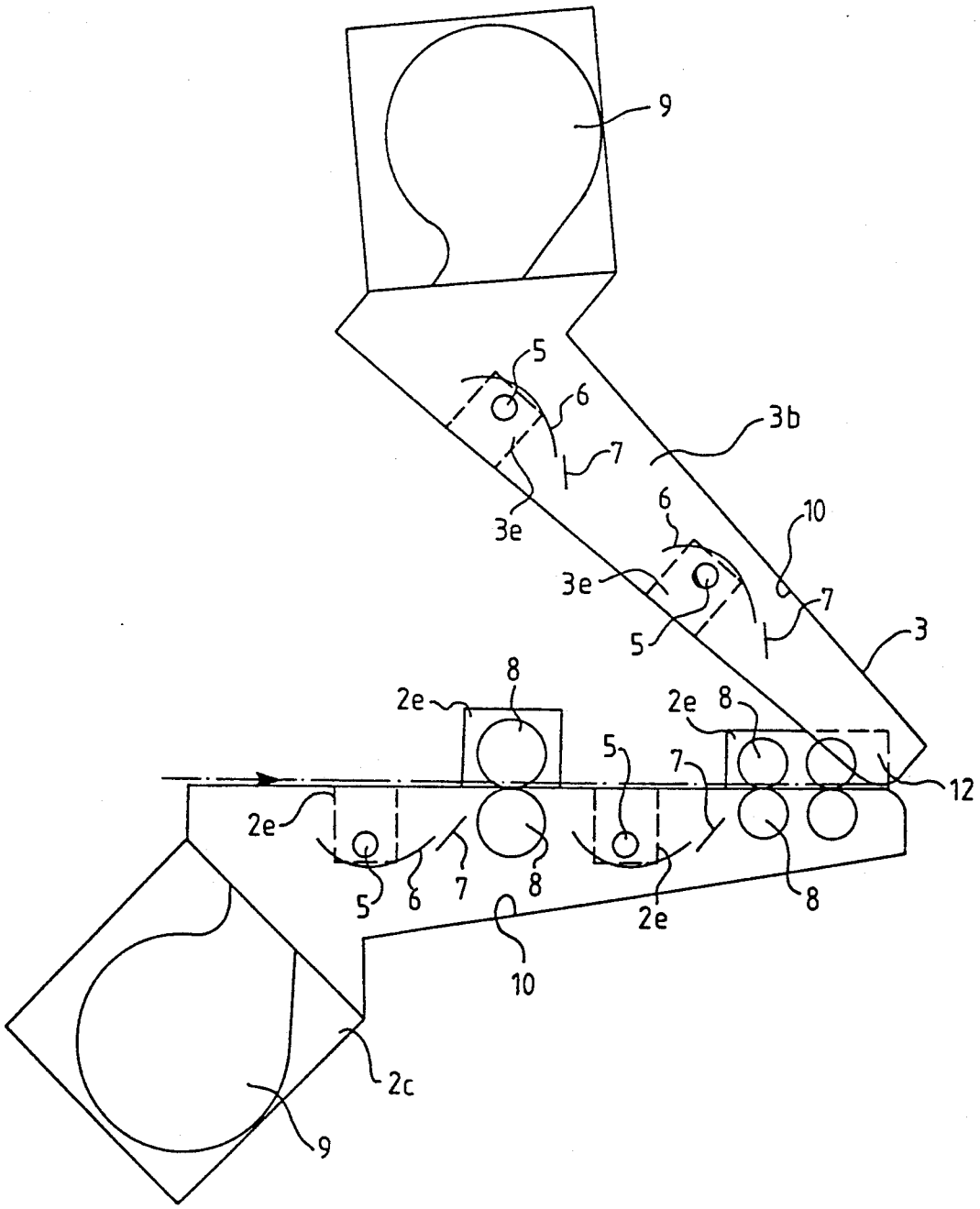
FIG. 3 is a view showing a horizontal arrangement of the dryer in accordance with the present invention.

The spatial construction of the housing part 3 is substantially symmetrical with respect to the housing part 2 relative to the sheet carrier web. However, the housing part 3 is arranged turnably about an axis 12 away from the housing part 2 and naturally can be locked to the latter in a closed condition. Moreover, known and not shown struts with arresting elements are provided to prevent dropping of the housing part 3 during opening. The housing part 3 accommodates parts which are similar to the radiators 5, reflectors 6, guiding sheets 7, rollers 8 and the blower 9 in the housing part 2. They are arranged so that in the closed condition of the housing part 2 they form together with the similar parts in the housing part 2 a symmetrical pair for the sheet carrier path. The chambers 2*a*–2*d* are shown in the drawings by solid lines, and the same is true for the radiators, reflectors, rollers and aerators which are not shown in the closed conditions of the housing parts 2 and 3. The housing and the inserted parts are provided over the width of the sheet carrier path with openings and with distances sufficient over the length of the sheet carrier path, so that the air stream from the blower 9 can flow over the rollers 8 and between the radiators 5 into the sheet carrier path and further in their direction. The blower 9 can be arranged at the lower end of the drying path and blow from the transporting device as shown in FIGS. 1 and 2. Also, it can be supported at the initial part of the drying path and blow into the sheet carrier transporting device as shown in FIG. 3. Moreover, the housing part 3 has chambers 3*b* and 3*c* which correspond to the chambers 2*b* and 2*c*.

As shown in FIGS. 1 and 2, the rollers 8 of the roller pair are all supported in the fixed housing part 2, since thereby their drive is facilitated. In contrast, the radiators 5, reflectors 6, and guiding sheets 7 and the blower 9 are supported in the turnable housing part 3. For this purpose bearing lugs or tongues 2*e* and 3*e* are provided. They are formed and arranged so that in the closed condition of the dryer they engage in one another in a tooth-like manner. For the sake of clear observation they are provided with references only in FIG. 1.

In contrast to FIGS. 1 and 2 in which a vertical dryer arrangement is shown with three radiator units 5, 6, 7, FIG. 3 shows an inventive dryer in a horizontal arrangement with only two radiator structural units. Parts operating in the same manner are provided with the same reference numerals as in FIGS. 1 and 2. The blowers are arranged in the inlet of the dryer, as mentioned above. The upper housing part 2 is formed as a cover-like swingable housing part. The bearing lugs 2*e* and 3*e* are arranged on the inner surfaces of the lateral housing walls, so that the partition line between both housing parts 2 and 3 is formed by a straight line. The air shaft 10 for the blower 9 is formed by an inner wall of the housing which extends in an inclined manner.

Figure 4:
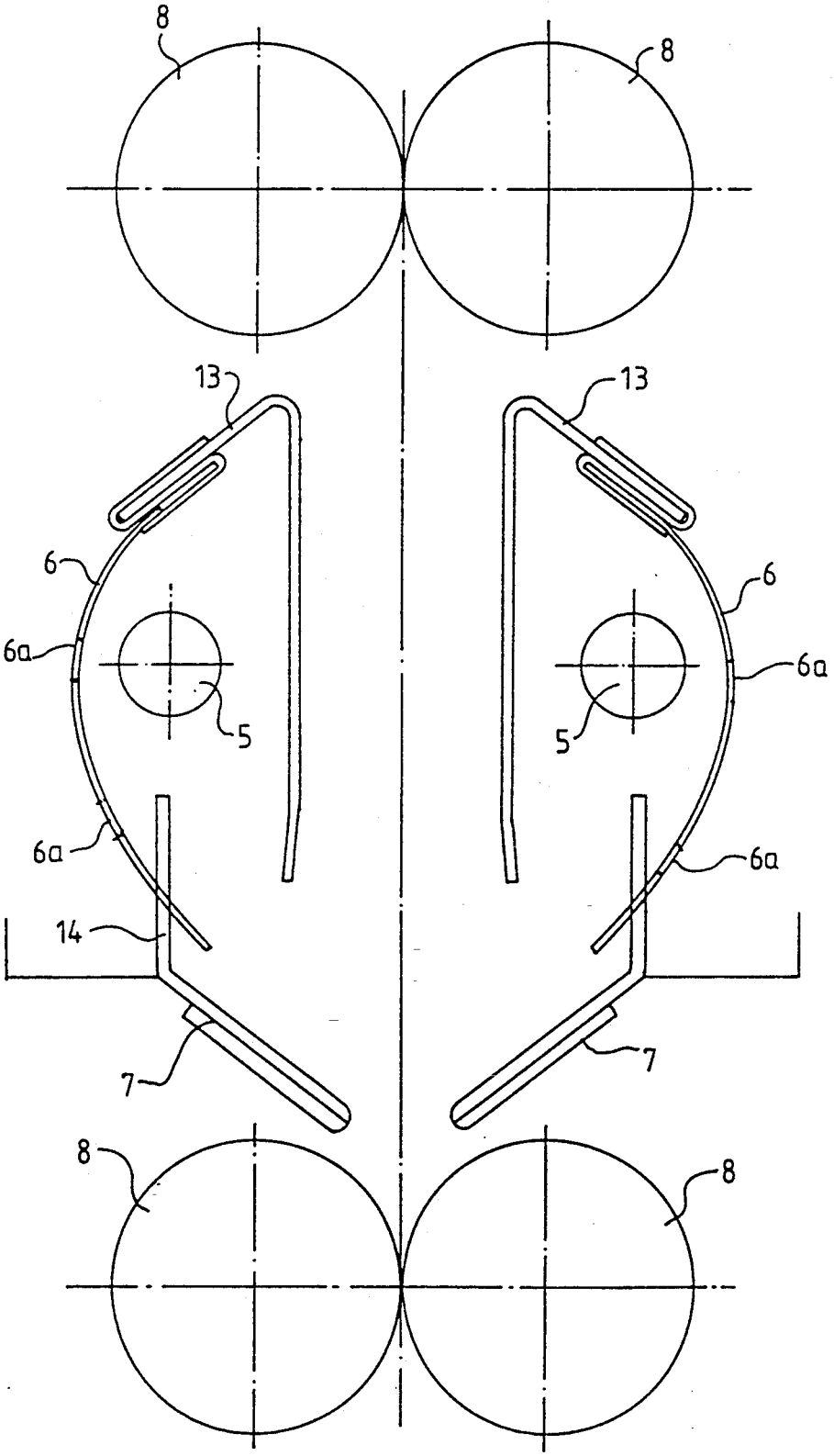
FIG. 4 is a view showing a structural unit of a radiator of the inventive dryer.

The radiators 5, reflectors 6, guiding sheets 7, rollers 8 are parts which are identical with one another. Therefore, independently of the size of the dryer and the number of the radiator pairs, only a small number of different structural elements must be arranged on the support. As can seen from FIG. 4, the reflectors and guiding sheets and also their holders are simple bending elements, while the holders 13 and 14 extend only over a small part of the dryer width so as not to interfere with the radiation and air stream of the blowers 9.

Openings 6*a* can be provided in the reflectors 6. The openings do not significantly affect the reflection, but allow passage of the blowing air.

Figure 5:
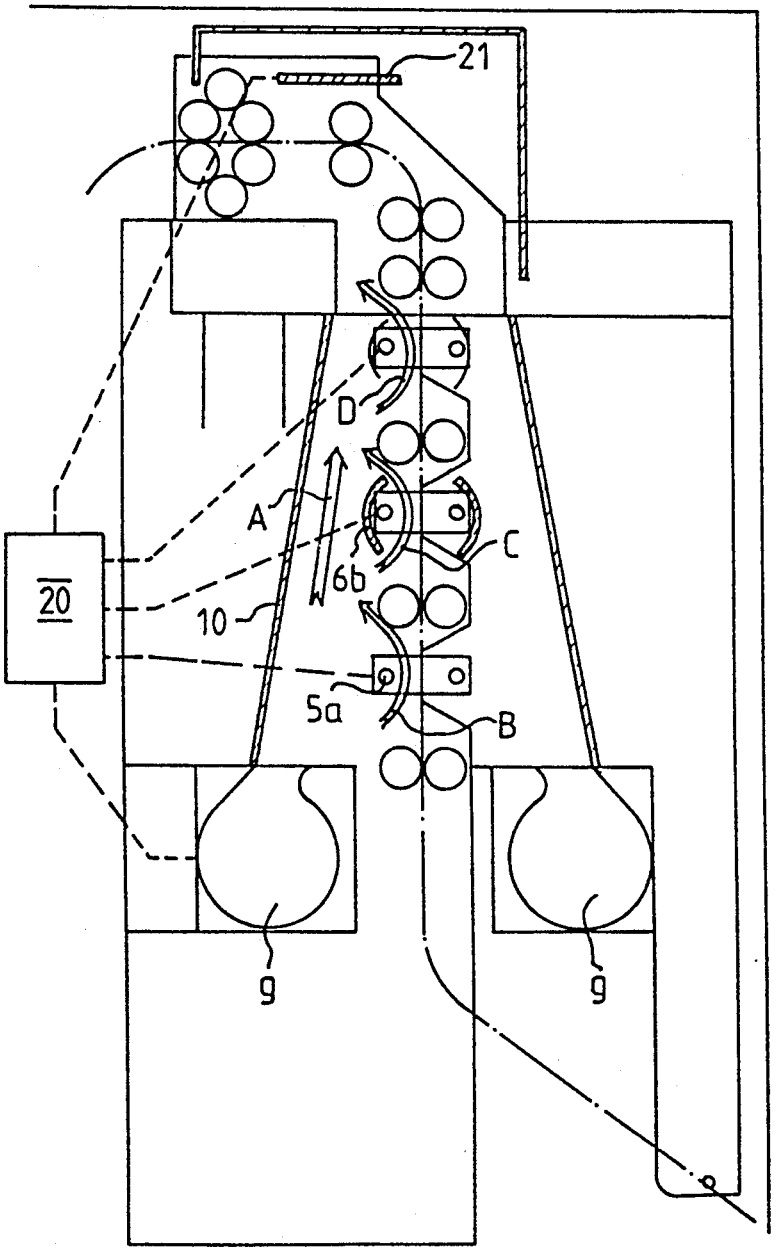
FIG. 5 shows the airflow and the temperature control of a dryer operating in accordance with the inventive method.

FIG. 5 shows the operation of the inventive dryer. The transverse flow blowers 9 are perfectly suitable for this drying method, since they provide a uniform flow through the whole width of the sheet carrier. Also, their operation is noiseless so that no special noise protective measures must be taken. Transverse blowers can be used however only for the above described drying method since the blowers here must not produce high pressure. For the shown example of a dryer for X-ray films, not depending on the number of the infrared radiators, an air feeding value of 200 cbm/h is sufficient.

A main air stream A is produced by the blower 9 in an air shaft 10. Before the first radiator 5*a* a partial air stream B is branched. It is moved between the radiator 5*a* and the transport path for the film, and united with the main air stream A. The partial air stream performs two functions. On the one hand, it eliminates the moisture which is produced under the action of the infrared radiation between the radiator and the film. On the other hand, the air flows over the outer surface of the film and removes further moisture. The partial air stream B is however heated by the radiator. This means that the main stream A is also heated as a result of the mixing with the partial air stream B and its moisture content is increased. In this manner the partial air stream C has a higher temperature than the partial air stream B. Thereby the convection part of the drying is increased relative to the radiation part which remains the same. The last partial air stream D has the maximum temperature and thereby the maximum convection part. In the inlet of the dryer, the main air stream A, after mixing with the partial air stream D, has a temperature up to approximately 55° C. and is used for pre-drying of the film in form of pure convection drying.

In order to increase the convection part which, as described hereinabove operates with a better quality, the radiator 5*a* is not provided with a reflector. The radiation is therefore also directed rearwardly and contributes to heating of the main stream A. The effect can be increased when the inclined limiting wall of the air shaft 10 is colored in black.

A regulation of the dryer is performed by a control electronic device 20. When the dryer power is for example too low, a too low temperature air is measured in the outflowing air by the temperature sensor 21. The control electronic unit then increases the power of the radiator 5*a* until the temperature in the discharge air lies within a predetermined region.

In the shown embodiment, the dryer power can be further increased to adapt to increasing film development speed, without the increase in the connection power. For this purpose the convection part is increased. Storage masses are built in the dryer to achieve this. They are heated during the so-called stand-by time or in other words the work pauses and the time in which the development baths are heated. As an example, the reflector 6*b* is shown in FIG. 5 and composed of a thicker material than the materials conventionally used for high storage capacity. The process is also controlled by the electronic unit 20. During the stand-by operation the dryer cools slowly and this temperature drop is detected by the sensor 21. The electronic unit 20 turns on the radiator 5 and the blower 9 in operation. The heat storage, for example the reflector 6*b* is heated. From a certain temperature in the discharge air, the dryer is again turned off. In this manner the dryer is always ready to operate and can, when the heat is required, give out the stored energy to the air stream.

It will be understood that each of the elements described above, or two or more together, may also find a useful application in other types of constructions differing from the types described above.

While the invention has been illustrated and described as embodied in a dryer for a film developing device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of drying a developed, moist sheet carrier after passing through a development device, comprising the steps of guiding a sheet carrier through a dryer which has a plurality of infrared radiators arranged along a path of the sheet carrier at both sides of the sheet carrier and reflectors provided at the side facing away from the sheet carrier which deviates the infrared radiation to the facing side of the sheet carrier; supplying a main air stream at both sides of the sheet carrier at the rear side of the reflectors, withdrawing from the main air stream a partial air stream and supplying the partial air stream between an infrared radiator and the sheet carrier, and thereafter uniting the partial air stream with the main air stream so that the temperature and the moisture of the main air stream increase in a flow direction.

2. A dryer for a film developing device, comprising at least one pair of oppositely located radiators and reflectors each arranged behind a respective one of said radiators; roller pairs including one roller pair arranged before said pair of radiators and another roller pair arranged after said pair of radiators for transporting a developed, wet sheet carrier along a sheet carrier path; at least two air blower means arranged at opposite sides of said sheet carrier path, said air blower means being offset relative to said pair of radiators in a direction of said sheet carrier and located at one end of said sheet carrier path and also formed as transverse flow blower means such that their air streams are oriented along a running direction of the sheet carriers, so that said air blower means supply a main air stream at both sides of the sheet carrier at a rear side of said reflectors, and a partial air stream is supplied between each of said infrared radiators and the sheet carrier and thereafter the partial air stream is united with the main air stream so that the temperature and the moisture of the main air stream increase in a flow direction.

3. A dryer as defined in claim 2, wherein said blower means are located before said pair of radiators in direction of said sheet carrier path.

4. A dryer defined in claim 2, wherein said blower means are located after said pair of radiators as in direction of said sheet carrier path.

5. A dryer as defined in claim 2, wherein said air blower means are arranged so that their air streams are directed in the running direction of the sheet carriers.

6. A dryer as defined in claim 2, wherein said air blower means are arranged so that their air streams are directed opposite to the running direction of the sheet carriers.

7. A dryer as defined in claim 2, wherein said radiators are infrared radiators.

8. A dryer as defined in claim 2, and further comprising reflectors each arranged behind a respective one of said radiators.

9. A dryer as defined in claim 2, wherein two of said radiators which are located the closest to said blower means are not provided with a reflector.

10. A dryer as defined in claim 2; and further comprising heat storing masses.

11. A dryer as defined in claim 2, wherein at least two of said reflectors are formed so that they operate as heat storing masses.

12. A dryer as defined in claim 2; and further comprising means forming an air outlet; a temperature sensor provided in said outlet; and a control unit connecting with said temperature sensor and controlling the blower means together with said radiators depending on a discharge air temperature sensed by said sensor.

13. A dryer as defined in claim 2; and further comprising a housing accommodating said radiators, rollers and blower means, said housing being subdivided into two housing parts substantially parallel to a running direction of the sheet carrier, one of said housing parts being swingable relative to the other of said housing parts between an open and a closed position, one of said radiators being located in one of said housing parts while the other of said radiators is located in the other of said housing parts and one of said blower means being located in one of said housing parts while the other of said blower means is located in the other of said housing parts.

14. A dryer as defined in claim 13, wherein said housing parts include a stationary housing part, said pairs of rollers being arranged before and after said pair of radiators in said stationary housing part.

15. A dryer as defined in claim 13, wherein said housing is separated along a separating line; and further comprising bearing tongues which in closed position of said housing parts extend along said separating line and engage one another in a tooth-like manner, said bearing tongues being arranged to support said radiators.

16. A dryer as defined in claim 13, wherein said housing is separated along a straight separating line and said housing parts have inner surfaces; and further comprising bearing tongues arranged on said inner surfaces of said housing parts and extending along said straight separating line to support said radiators and said rollers so that they do not hinder the closing of said housing parts.

17. A dryer as defined in claim 13, wherein said housing parts include a swingable housing part; and further comprising a frame for supporting at least said swingable housing part.

18. A dryer as defined in claim 2, wherein said radiators of said pair are formed identically to one another.

19. A dryer as defined in claim 2; and further comprising reflectors which are arranged behind a respective one of said radiators, a pair of guiding sheets, a pair of mounting elements, said radiators, said reflectors, said guiding sheets, and said mounting elements of each of said pairs being arranged identically to one another.

20. A dryer as defined in claim 2; and further comprising reflectors each arranged behind a respective one of said radiators; and means forming an air shaft located behind each of said reflectors and inclined relative to said sheet carrier path.

* * * * *